United States Patent [19]

Handley et al.

[11] Patent Number: 4,807,707

[45] Date of Patent: Feb. 28, 1989

[54] SAMPLING APPARATUS AND METHOD

[76] Inventors: James P. Handley, 3018 Hidalgo Dr., Orlando, Fla. 32806; Philip B. Hildebrand, 541 Ventris Ct., Maitland, Fla. 32751

[21] Appl. No.: 112,300

[22] Filed: Oct. 26, 1987

[51] Int. Cl.[4] ..... E21B 49/08

[52] U.S. Cl. ..... 175/20; 73/864.74; 175/21; 175/59

[58] Field of Search ..... 175/19, 20, 21, 59, 175/60, 321, 324, 417; 166/264, 169; 73/864.74, 864.51, 864.62, 864.43

[56] References Cited

U.S. PATENT DOCUMENTS

| | | | |
|---|---|---|---|
| 2,141,261 | 12/1938 | Clark | 175/19 X |
| 3,943,750 | 3/1976 | McLaughlin | 73/864.74 X |
| 4,261,203 | 4/1981 | Snyder | 175/21 X |
| 4,310,057 | 1/1982 | Brame | 175/21 |
| 4,335,622 | 6/1982 | Bartz | 73/864.74 |
| 4,669,554 | 6/1987 | Cordry | 175/59 |

OTHER PUBLICATIONS

"HydroPunch" catalog sheet, Version 90-1187,1987.

"Groundwater Sampling Without Wells", Kent E. Cordry et al., Sixth National Symposium and Exposition of Aquifer Restoration and Groundwater Monitoring-Columbus, Ohio May 20, 1986.

*Primary Examiner*—Hoang C. Dang

[57] ABSTRACT

A sampling system and method for obtaining subsurface samples of soil gas and ground water includes a sampling probe which is pushed into the ground with a plurality of thrust rods. The sampling probe has a pointed head telescoped within a sampling housing during insertion. An umbilical tube communicating with the housing is utilized to introduce inert gas into the housing, extending the probe from the housing. Reduction of the gas pressure permits water or gas to flow through a filter and check valve into the housing by piezometric pressure. A computer monitoring system permits control of gas pressure to collect a desired amount of sample and to store data for later analysis.

20 Claims, 2 Drawing Sheets

SAMPLING APPARATUS AND METHOD

BACKGROUND OF THE INVENTION

1. Field of the Invention

The present invention relates to sampling of soil gas and ground water, and more particularly to a soil gas and ground water sampling system and method for rapidly and accurately obtaining such samples.

2. Description of the Prior Art

The testing of ground water in the United States and other areas of the world has become increasingly important in recent years due to discovery of contamination of such waters by industrial and agricultural activities. In the past, it has been necessary to drill monitoring wells to the desired depth to obtain an accurate sample of ground water. This technique has the obvious disadvantages of being extremely time consuming and difficult to properly construct. When monitoring wells are employed for determining the true contaminant levels in aquifers at various depths, foreign materials can be introduced during the retrieval of samples which would alter the true ground water quality obtained by monitoring wells and volatilization of the samples can produce errors. One attempt to improve on this common technique is the BAT sampler developed by BAT Envitech, Inc. of Long Beach, Calif. The BAT sampler utilizes a small evacuated glass vial which is lowered into the monitoring well and filled by punching with a needle. Another approach is a device developed by James M. Montgomery Consultants in Pasadena, Calif., known as the Hydropunch. This device is a sampler that is driven into the ground and allowed to fill from the piezometric pressure of the ground water with no control or monitoring of the filling process. During insertion of the Hydropunch sampler, it is exposed to soil and ground water which overlie the depth at which a sample is to be taken permitting contamination of the sample.

There is a need for a soil gas and ground water sampler and method which will permit rapid sampling at any required depth in soil without drilling of monitoring wells, which has the ability to sample water from existing monitoring wells, open bodies of water, in and around buried tanks, and the like and in which the water sample can be obtained under close control of filling of the sampler, to minimize introduction of foreign contaminants, and to eliminate volatilization of the water sample.

SUMMARY OF THE INVENTION

The present invention is a ground water and soil gas sampling apparatus and method having a sampler probe which includes a hollow cylindrical housing having a diameter on the order of 1 to 2 inches and an inside diameter on the order of ¾ to 1½ inch. The housing has a length sufficient to hold a desired sample volume which may be on the order of 700 milliliters. A sampling probe head is engaged into the distal end of the probe housing and includes a solid, sharpened thrust point at the distal end of the head. The head is adapted to telescope within the housing such that the thrust point portion thereof is in contact with the distal end of the housing. In this position, the probe can be pushed or driven into the ground or inserted into wells, tanks, or other volumes of water to be sampled. Since the sampling probe head is enclosed by the housing, no introduction of foreign material or contaminants from above the sampling depth can be introduced. The proximal end of the housing may be coupled to a series of standard drill or thrust rods of sufficient length to reach the desired depth for sampling. An umbilical tube is passed through the core openings of the thrust rods into the probe housing to provide a passage for pressurized gas from the control system into the probe housing. The umbilical tube also contains a set of wire leads to a liquid level transducer disposed within the probe housing.

As will be described more fully below, the probe head may be extended from the probe housing by means of gas passed under pressure into the probe housing. In the extended condition, a series of inlet openings through the probe head element are exposed. The inlets are covered with a filter assembly. The filter assembly will therefore be exposed to the water or gases to be sampled. After depressurization of the probe housing, the ground water or gases will then flow, under piezometric pressure, through the inlets via a check valve into the probe housing. When sampling water, a liquid level sensor will provide signals via the umbilical tube to control instrumentation which monitors the amount of water inflowing into the probe housing.

A computer system is utilized in the control instrumentation having a CRT display and preferably with a digital plotter driven therefrom. The computer will monitor the conditions in the probe housing such as gas pressure and water level. The dynamic variations of these parameters during operation can be plotted versus time on the plotter and the collected data stored in the computer for later analysis. The control system will generally include a container of an inert gas such as argon under high pressure, a pressure control valve and regulator, and a pressure transducer connected to the umbilical tube. The pressure transducer is connected to the computer to permit monitoring of the gas pressure in the probe housing. The inflow of water or gases is controlled by the applied gas pressure.

After the sampling probe is filled, the probe is withdrawn and the sample removed for analysis. In some instances, it may be desirable to retrieve the sample without withdrawing the probe. Samples may be withdrawn through the umbilical tube by applying a negative pressure from a vacuum system to the tube.

The sampling probe may be thrust into the ground to the desired depth of the water to be sampled, may be inserted into existing monitoring wells or other types of wells, and into lakes, streams, and the like. The sampler may also be used with storage tanks having openings large enough to admit the probe.

It is therefore a principal object of the invention to provide a water sampling probe that can access ground water without drilling of wells and in which the rate and volume of water entering the probe can be accurately monitored and controlled.

It is another object of the invention to provide a ground water sampling probe and a method of use which will permit sampling of subsurface water without drilling of monitoring wells and which can be inserted into any volume of water.

It is still another object of the invention to provide a ground water sampling probe system in which the inflow of water can be accurately controlled by use of an inert gas under pressure.

It is yet another object of the invention to provide a ground water sampling probe in which water can be sampled and brought to the surface without contamination or volatilization of the sample.

It is another object of the invention to provide a sampling probe for thrusting into soil for extracting a sample of gas or vapors from the subsurface soil into the sampler.

It is another object of the invention to provide a sampling probe inserted into subsurface soil and having an umbilical tube through which a sample of water or gas can be withdrawn through the umbilical tube.

It is still another object of the invention to provide a ground water and gas sampling apparatus and method in which data may be collected during a sampling process from which accurate engineering parameters can be obtained.

It is yet another object of the invention to provide a water or gas sampling probe and method utilizing a computer for monitoring and for storing data for later analysis.

These and other objects and advantages of the invention will become apparent from the following detailed description when read in conjunction with the drawings.

DETAILED DESCRIPTION OF THE PREFERRED EMBODIMENT

Figure 1:
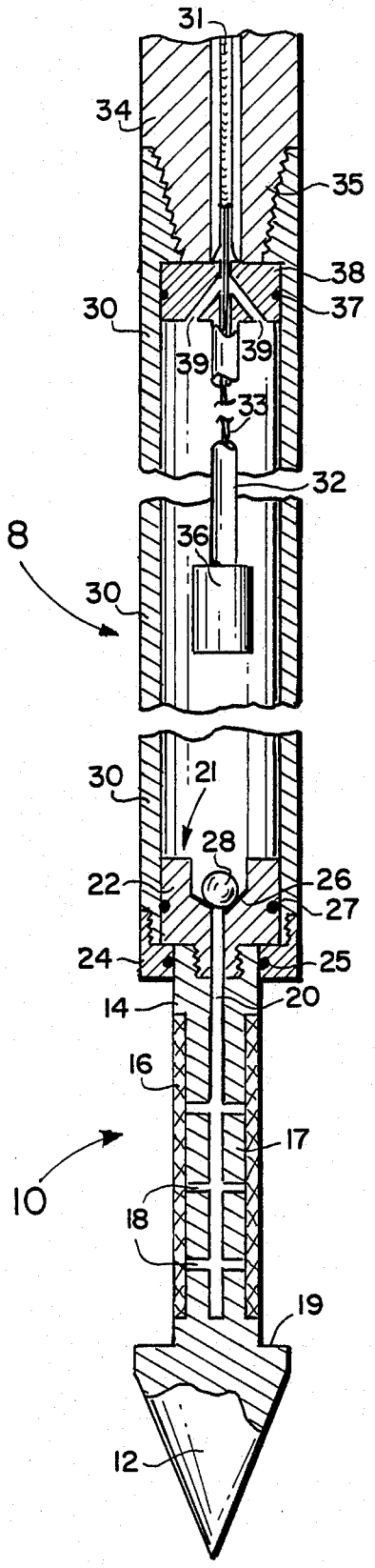
FIG. 1 shows a cross-sectional view of the water or gas sampling probe of the invention with the sampling probe head in the extended position.

Referring to FIG. 1, a cross-section of the sampler probe portion of the invention is shown generally at 8. The sampler probe 8 includes a probe housing portion 30 and a sampling probe head 10 in an extended position. Probe housing 30 is a cylindrical tube formed from a non-corrosive material; for example, stainless steel. The distal end of probe housing 30 is threaded to accept a cap 24 having an O-ring seal 25. At the proximal end of probe housing 30, a tapered internal thread 35 is provided mating with standard threads on thrust rod 34. As will be discussed more fully below, a plurality of thrust rods 34 may be coupled together with sampler probe 8 for pushing probe 8 into the ground to a desired depth. At the proximal end of probe housing 30, a probe plug assembly 38 is disposed having an O-ring seal 37. Depending from probe plug assembly 38 is transducer support tube 32 having a liquid level transducer 36 attached to the lower end thereof. Probe plug assembly 38 and support tube 32 are a non-corrosive material such as stainless steel. A set of transducer leads 33 from liquid level transducer 36 extend through support tube 32. A flexible plastic umbilical tube 31 is fed through the central bore 29 of thrust rod 34 and other thrust rods attached thereto and coupled via a tube compression fitting to the upper end of probe plug assembly 38. As will be recognized, transducer leads 33 pass through umbilical tube 31. A set of gas ports 39 is provided through plug assembly 38 which communicate with the interior of umbilical tube 31 for passage of gas therethrough as will be discussed hereinbelow.

Sampling probe head 10 is preferably formed from stainless steel and includes a thrust point 12 at its distal end. As seen in the cross-sectional view in FIG. 1, a coaxial sample passage 20 is provided through a portion of probe head 10, with a plurality of water inlets extending radially from passage 20 to an outer surface of cylindrical shank portion 14 of probe head 10. A cylindrical recess 17 in shank 14 accepts a cylindrical filter element 16 seen in cross-sectional view. Shank 14 is threadedly engaged with a check valve body 22 of check valve 21. Check valve body 22 includes a seat 26 having a check ball 28 resting thereon by gravity. As will be recognized, water may flow upward through passage 20 and, with sufficient pressure, pass through seat 26 and check bal 28. Pressure downward on ball 28 will prevent loss of water therethrough. Check valve body 22 includes an O-ring seal 27.

Figure 2:
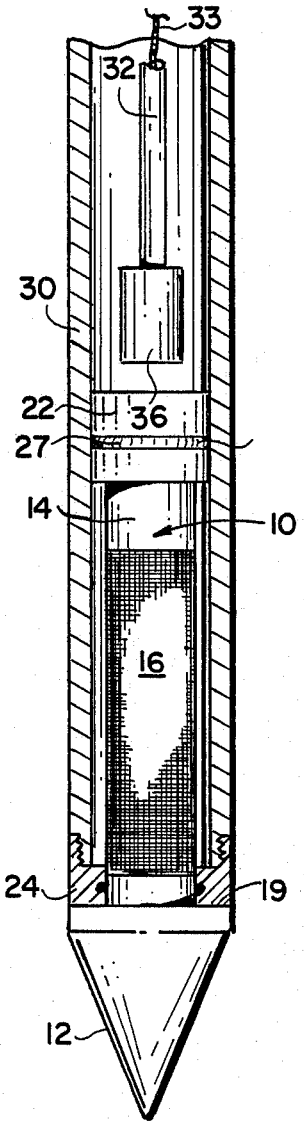
FIG. 2 shows a cross-sectional view of a portion of the sampling probe with the probe head in the retracted position.

Turning now to FIG. 2, a portion of sampling probe 8 adjacent the distal end of probe housing 30 is shown in cross-sectional view having sampling probe head 10 in its retracted position in which shoulder 19 of thrust point 12 is in contact with cap 24. As will be noted, liquid level transducer 36 is disposed just above check valve 21 when probe head 10 is in the retracted position.

Sampler probe 8 may be made with any desired dimensions. Typically, the length of probe housing 30 may be 2 meters with an outside diameter of 1.375 inches and an inside diameter of 0.875 inches. These dimensions will provide up to about 1 liter capacity of the housing 30. The small diameter of probe housing 30 will permit the probe to be inserted into storage tanks having small access openings.

Figure 3:
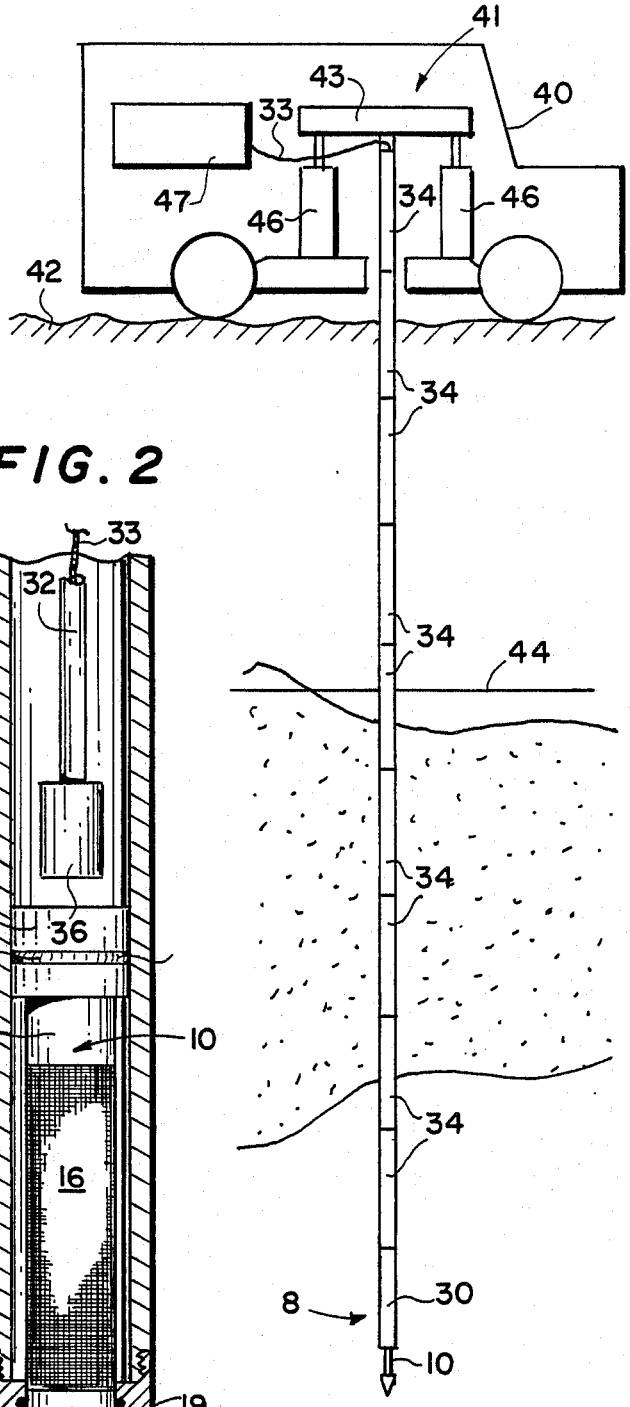
FIG. 3 is a schematic diagram of the ground water sampling system of the invention in operation in which the sampling probe has been pushed into the ground.

FIG. 3 provides a schematic diagram of the invention in use in obtaining a sample from soil 42. A vehicle 40 is provided with a hydraulic frame 41 having a cross member 43 movable by a pair of vertically oriented actuators 46. In the diagram, a plurality of thrust rods 34 are shown attached to probe 8 and connected to hydraulic load frame 41. Umbilical tube 31 may be seen connected from the top section thrust rod 34 to control system 47.

As will be understood, when it is desired to obtain a ground water sample from soil, the number of thrust rods 34 required to obtain the desired depth is determined and assembled on a suitable rack. In FIG. 3, the umbilical tube 31, connected to the proximal end of sampler probe 8 has been threaded through the thrust rods 34 which are, at this point, separate from each other. The probe 8 is connected to the first thrust rod which is attached to cross member 43 of hydraulic load frame 41. Actuators 46 are energized to force the thrust point 12 of probe 8 into the ground to the limit of the actuator movement. The first thrust rod is disconnected from the hydraulic load frame which is then fully raised and the second rod installed. The process is repeated until the desired number of thrust rods have been connected and extended. In FIG. 3, it is assumed that water level 44 has been passed and that probe 8 is at a desired level for ground water sampling. During the introduction of sampler probe 8 into the soil, the probe head 12 is in its retracted position as shown in FIG. 2.

Figure 4:
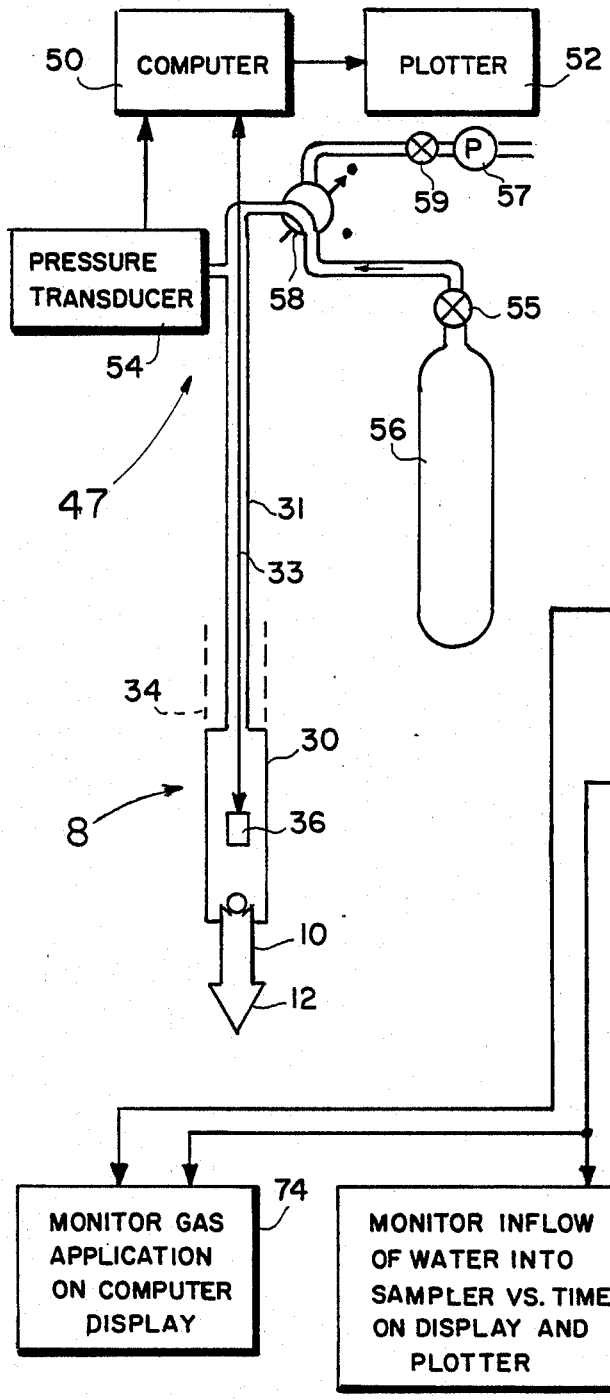
FIG. 4 is a schematic diagram of the ground water sampling system shown control elements thereof.
Figure 5:
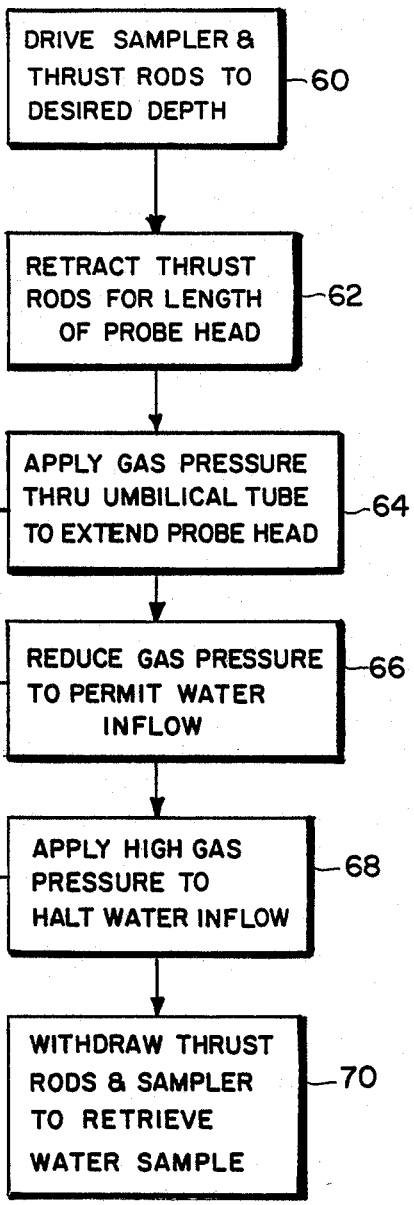
FIG. 5 is a functional flow diagram showing the sequence of steps to practice the method of the invention.

Details of control system 47 may be seen by referring to the schematic diagram in FIG. 4. It will be recognized that umbilical tube 31 is connected via selector valve 58 and pressure regulator 55 to gas bottle 56 which contains an inert gas, preferably argon, under high pressure. A pressure transducer 54 is connected into umbilical tube 31 for monitoring the pressure therein. As will be seen, the umbilical tube 31 connects to housing 30 of probe 8. As previously mentioned, when probe 8 is being pushed down into the soil, probe head 10 is in the retracted position. When the desired depth is reached, hydraulic load frame 41 of FIG. 3 is raised an amount approximately equal to the length of probe head 10. This procedure will leave a cavity just below thrust point 12. Simultaneously with the raising of the load frame 41, gas from bottle 56 is introduced via umbilical tube 31 into housing 30. Sufficient pressure is provided to force probe head 10 downward into the cavity in the soil until it is in its fully extended position. The applied pressure is monitored on the display of computer 50 from which it may be determined when probe head 10 is fully extended. The steps of the method of the invention that have been described are shown in flow diagram form in FIG. 5 as steps 60, 62, and 64. It may be also noted that in step 64, the application of the gas pressure is monitored on the computer display.

In general, the pressure required to extend probe head 10 will be much greater than the piezometric pressure of the subsurface water and no water will flow into the probe head 10. Thus, in step 66, the gas pressure is reduced to the point at which inflow of water will occur through filter element 16, water inlets 18, sample passage 20, and through check valve 21 into the interior of probe housing 30. The rate at which the inflow occurs is controllable by the gas pressure. The operator may then monitor the amount of the water sample in housing 30 from readings by the computer of liquid level transducer 36 which is connected by leads 33 to computer 50. As the water level in housing 30 reaches liquid level transducer, a plot of the inflow as a function of time may be made on plotter 52. Thus, the system advantageously provides the operator with exact knowledge of the level of the sample without the necessity of withdrawing the sampling probe. When the desired volume of water is collected, the gas pressure is increased sufficiently to overcome the piezometric pressure and to therefore stop the inflow of water. Check valve 21 will close, securing the sample within the probe 8.

After the desired sample is collected, the thrust rods are withdrawn sequentially and stored in their rack until the probe is retrieved As will be understood, the probe is extracted from the ground in the extended condition which prevents contamination of the sample.

The invention permits the sampling of ground water without necessity of drilling sampling wells as described above. However, the sampling technique is also suitable for drawing samples from any accessible source of water such as existing monitoring wells or stand pipes, pools, tanks, and other accessible volumes of water by dripping the probe into such water and controlling the inflow by means of the gas pressure regulating and monitoring system.

The sampling apparatus of the invention may also be used to collect soil gas samples. The procedure is basically the same as described above with respect to ground water sampling; however, liquid level transducer 36 is not used. After the inert gas pressure is reduced in housing 30, the umbilical tube 31 is connected via selector valve 58 (FIG. 4) to vacuum pump 57 and regulator valve 59. Negative pressure is thus applied to housing 30 to remove the inert gas from the system. Several sample volumes of gas are drawn through probe 10, housing 30, and umbilical tube 31 by vacuum pump 57 to ensure a pure sample. Computer 50 monitor the procedure to permit control of pressure and flow.

During operation of the system, all data received by the computer can be stored on disc for later checking, evaluation, or other purposes. Mathematical models may be designed to utilize such data to develop highly accurate engineering design parameters.

The preferred embodiment has been described in detail for exemplary purposes and numerous modifications can be made without departing from the spirit and scope of the invention.

We claim:

1. Apparatus for sampling soil gas or ground water comprising:

a cylindrical probe housing having a chamber for receiving samples of soil gas or ground water;

a cylindrical probe head having a thrust point at a distal end thereof and a cylindrical shank telescopically engaged with a distal end of said housing, said shank having a central passage communicating with said chamber, and a plurality of inlet passages from the exterior thereof communicating with said central passage, said probe head having a first position in which said shank is telescoped within said housing blocking said inlet passages and a second position in which said shank is extended for permitting flow externally through said inlet and central passages into said housing;

a check valve disposed between said central passage and said chamber for passing samples from said inlet passages and central passage into said chamber;

a control system having a source of inert gas under pressure and gas pressure regulating means; and an umbilical tube having a first end connected to a proximal end of said probe housing and a second end connected to said inert gas source and said pressure regulating means for introducing and controlling the pressure of said inert gas in said housing wherein high gas pressure in said housing causes said probe head to extend from said first position to said second position, and low gas pressure in said housing causes a sample of gas or water to flow by piezometric pressure through said inlet and central passages of said extended probe head, and through said check valve into said chamber.

2. The apparatus as recited in claim 1 in which said shank includes a filter element over said inlet passages.

3. The apparatus as recited in claim 1 in which said control system further includes:

a level transducer disposed in said housing chamber;

a pressure transducer connected to said regulating means; and computer means having input connections from said level transducer and said pressure transducer for monitoring and displaying a level of water in said housing chamber and a gas pressure in said housing chamber.

4. The apparatus as recited in claim 3 in which said computer means includes data storage means for storing pressure and level data as functions of time.

5. The apparatus as recited in claim 4 in which said computer means includes plotting means for producing plots of said pressure and level data as functions of time.

6. The apparatus as recited in claim 1 which further comprises means for thrusting said probe housing and probe head into soil to be sampled.

7. The apparatus as recited in claim 6 in which said thrust means includes:

a first thrust rod having a distal end attached to the proximal end of said probe housing;

a hydraulically operated frame temporarily attached to a proximal end of said first rod for pushing said probe housing and said probe head into the soil; and a plurality of other thrust rods to be successively coupled in a string to said first thrust rod, the free proximal end of each of said other thrust rods temporarily and successively attached to said frame for pushing said probe housing and said probe head more deeply into the soil.

8. Apparatus for sampling subsurface soil gas and ground water comprising:

(a) a sampling probe including (i) a cylindrical tubular probe housing having a distal end and a proximal end, (ii) a probe head having a thrust point at a distal end thereof, a cylindrical shank portion telescopingly engaged in the distal end of said probe housing, a filter assembly, and inlet passages communicating with the interior of said probe housing, and (iii) a check valve disposed between said inlet passages and the interior of said probe housing, (b) a control system having (i) a source of inert gas under pressure, (ii) regulator means connected to said gas source for controlling an output pressure from said gas source, (iii) monitoring means for monitoring said gas output pressure; and (c) a flexible umbilical tube having a first end thereof connected to receive said gas output pressure, and a second end thereof connected to said proximal end of said probe housing wherein a high gas pressure in said probe housing causes said probe head to extend from a telescoped position in said probe housing, and a low gas pressure in said housing will cause a soil gas or ground water sample to flow under piezometric pressure via said filter assembly, said inlet passages, and said check valve into said probe housing when said sampling probe is disposed in soil containing soil gas or ground water.

9. The apparatus as recited in claim 8 which further comprises a liquid level transducer disposed in said probe housing and connected to said monitoring means via leads through said umbilical tube, said transducer for producing signals proportional to a liquid level in said probe housing.

10. The apparatus as recited in claim 9 in which said monitoring means includes:

a gas pressure transducer; and a computer having a display screen, said computer connected to said gas pressure transducer and programmed to display gas pressure as a function of time, and connected to said liquid level transducer to display a liquid level in said probe housing as a function of time.

11. The apparatus as recited in claim 10 in which said monitoring means further comprises a plotter for plotting gas pressure and liquid level data as a function of time.

12. The apparatus as recited in claim 10 in which said computer includes memory means for storing data representative of gas pressure and liquid level as a function of time.

13. A method of obtaining a sample of subsurface water utilizing a probe having a probe housing, a probe head telescopically engaged with the probe housing, the probe having a first position in which the probe head is retracted into the probe housing, and a second position in which the probe head is extended from the probe housing, comprising the steps of:

(a) driving said probe into soil to a desired depth with the probe in the first retracted position;

(b) filling the probe housing with an inert gas under pressure to cause the probe head to extend to the second position;

(c) reducing the gas pressure in the probe housing to permit ground water to flow through the extended probe head into the probe housing under piezometric pressure;

(d) increasing the gas pressure to halt the ground water inflow; and (e) withdrawing the probe to retrieve the ground water sample.

14. The method as recited in claim 13 in which step (b) includes the step of withdrawing the probe a distance essentially equal to the length of an extended portion of the probe head when in the second position.

15. The method as recited in claim 13 in which step (d) includes the step of monitoring the level of ground water in the probe housing.

16. The method as recited in claim 15 which includes the further steps of:

(f) providing a liquid level transducer in the probe housing;

(g) providing a pressure transducer communicating with the probe housing;

(h) providing computer means connected to the pressure transducer and the liquid level transducer; and (i) monitoring the gas pressure and the ground water level in the probe housing with the computer means.

17. A method of obtaining a sample of subsurface soil gas utilizing a probe having a probe housing, a probe head telescopically engaged with the probe housing, the probe having a first position in which the probe head is retracted into the probe housing, and a second position in which the probe head is extended from the probe housing, comprising the steps of:

(a) driving said probe into soil to a desired depth with the probe in the first retracted position;

(b) filling the probe housing with an inert gas under pressure to cause the probe head to extend to the second position;

(c) reducing the inert gas pressure in the probe housing to permit soil gas to flow through the extended probe head into the probe housing under piezometric pressure;

(d) increasing the inert gas pressure to halt the soil gas; and (e) withdrawing the probe to retrieve the soil gas.

18. The method as recited in claim 17 in which step (b) includes the step of withdrawing the probe a distance essentially equal to the length of an extended portion of the probe head when in the second position.

19. The method as recited in claim 17 which includes the further step of:

(f) applying negative pressure to the probe housing to exhaust the inert gas therefrom; and (g) permitting a plurality of sample volumes to be exhausted from the probe housing.

20. The method as recited in claim 19 which includes the further steps of:

(h) providing a pressure transducer communicating with the probe housing;

(i) providing computer means connected to the pressure transducer; and (j) monitoring the inert gas pressure and the soil gas pressure in the probe housing with the computer means.

* * * * *